United States Patent [19]

Mair et al.

[11] Patent Number: 4,920,622

[45] Date of Patent: May 1, 1990

[54] APPARATUS FOR THE SPREADING THE GUIDING OF A WEB OF FLEXIBLE MATERIAL

[75] Inventors: Franz Mair, Augsburg; Wolfgang Lönner, Neusäss, both of Fed. Rep. of Germany

[73] Assignee: Erhardt & Leimer GmbH, Augsburg, Fed. Rep. of Germany

[21] Appl. No.: 256,841

[22] Filed: Oct. 12, 1988

[30] Foreign Application Priority Data

Oct. 13, 1987 [DE] Fed. Rep. of Germany ..... 8713698

[51] Int. Cl.[5] ..... D06C 3/06

[52] U.S. Cl. ..... 26/75

[58] Field of Search ..... 26/72, 75, 77, 78, 99, 26/105

[56] References Cited

U.S. PATENT DOCUMENTS

| | | | |
|---|---|---|---|
| 1,347,714 | 7/1920 | Rowley | 26/78 |
| 1,753,033 | 4/1930 | Taveira | 26/78 |
| 2,635,873 | 4/1953 | Worm | 26/78 |
| 3,838,481 | 10/1974 | Kuroda | 26/77 |
| 4,224,724 | 9/1980 | Bassani et al. | 26/75 |

*Primary Examiner*—Werner H. Schroeder

*Attorney, Agent, or Firm*—Herbert Dubno

[57] ABSTRACT

An apparatus for guiding and spreading a textile web comprising spreading rollers extending across the full width of the web and mounted on a unit in the support for the spreading rollers, pairs of fingerlike guide rollers which can be inclined toward one another in the direction of travel of the web. The holders and the two pairs of guide rollers can be moved together and apart by a threaded spindle.

18 Claims, 2 Drawing Sheets

APPARATUS FOR THE SPREADING THE GUIDING OF A WEB OF FLEXIBLE MATERIAL

FIELD OF THE INVENTION

Our present invention relates to an apparatus for the spreading and guiding of a travelling web of flexible material, especially a textile web and, more particularly, to an apparatus of this type which is provided with a spreading device and a guiding device downstream from the spreading device.

BACKGROUND OF THE INVENTION

In German Patent Document No. DE-OS 28 21 650, an apparatus of the latter type is described which comprises a spreading device having two spreading rollers extending across the path of the web on opposite sides thereof and engaging the opposite surfaces of the web, each of these rollers having threadlike formations, hereinafter referred to as threads, of a different hand or screw sense so that upon rotation of the rollers, the helical rib or thread on one longitudinal side of the web of each roller draws the material away from the center while the thread of the opposite hand on the same roller draws the material on the opposite longitudinal side of the roller away from the center to thereby draw out laterally or "spread" the web of material.

The guide device provided downstream of the spreading device is constituted as a unit independent of the spreading device.

This downstream unit comprises two spaced apart parallel guide rollers around which the web is partially slung and which are mounted in a frame fixed on guide members which are guidable in converging straight guides lying parallel to the plane of the fabric and converging in the fabric travel direction.

The guide parts in the respective guides are so connected together by the frame carrying the rollers that a swing-shifting movement of the rollers when the guide parts are displaced is possible.

That means that the rollers which extend across the width of the fabric can be so inclined that different inclinations can be established for appropriate correction to the respective side.

A drawback of this device is the large spatial requirement for the device, since guides on both sides of the fabric web are required and because considerable free space will be provided laterally of the frame carrying the two rollers, since the rollers may have to be shifted considerably to each side and appropriately swung as part of their adjustment movement.

Swing-shifting roller arrangements, moreover, require a large number of parts, complex assembly and expensive control and maintenance procedures.

Indeed, where limited space is available, this type of guide unit cannot be used and this is important because such devices frequently are desirable in housings in which the fabric is treated and which have only limited lateral space. A further disadvantage of the aforedescribed apparatus is the fact that it occupies considerable space in the longitudinal direction as well because of the inclined guides and the drive for the guide members thereby requiring that the guide unit be located relatively far from the spreading unit.

A large separation between the two units entails the danger that the spreading effect may have ended at an edge region of the fabric before the fabric enters the guide device so that folds may be created or that the edge may pull inwardly, thereby defeating the purpose of the spreading unit or detrimentally effecting guidance.

It is known in practice to provide the spreading spindles so that they engage only the edge regions of the fabric and to provide each of the threadlike spreading spindles with a web guide which comprises a pair of rollers gripping the edge region of the goods. This combination has the drawback that holes or tears in the goods can be generated by the threaded spreading spindles or can detach on the guiding spindles to the detriment of proper advancement of the web.

Furthermore, with such systems, it is possible for the edges of the web to spring suddenly inwardly or to pull out from the spreading and guide device upon a tear of the fabric. The fabric can also jump out of the feed plane which must lie precisely between the two rollers.

The goods lie with a slight looping around the upper or lower rollers of the web guide. An automatic threading of the web through the spreading and guide device is not possible, since the goods tend to be pulled to one side or the other. In operation, the apparatus may be turned off completely and the web threaded through the apparatus by hand in a time consuming operation.

OBJECTS OF THE INVENTION

It is the principal object of the present invention to provide an apparatus for the spreading and guiding of a flexible web which can be provided in a relatively small space, has a low cost price and is economical to operate, is of simple construction and can be easily adjusted to a variety of textile web width and can feed the web reliably for long periods of time, without the drawbacks enumerated above.

More generally, it is an object of the invention to provide an improved spreading and guide apparatus for a web of flexible material, especially a textile web which can occupy less space than systems provided heretofore and is more reliable and easier to operate.

SUMMARY OF THE INVENTION

These objects and others which will become more apparent hereinafter are attained, in accordance with the present invention, in an apparatus for spreading and guiding a flexible web which comprises:

a spreading device disposed along a path of a moving flexible web and including:

two spaced-apart spreading rollers extending across a width of the web generally transverse to a travel direction thereof, each of the spreading rollers being formed with thread formations of opposite hand at each longitudinal side of the web, the spreading rollers engaging opposite surfaces of the web, common support means for journaling the spreading rollers, and means for rotating the spreading rollers to spread the web as the web is engaged by the spreading rollers; and a guide device downstream of the spreading rollers in the direction, the guide device including:

respective pairs of fingerlike guide rollers straddling and engaging between the rollers of each pair only respective longitudinal-edge regions of the web at the opposite sides thereof, and means for journaling the guide rollers only at ends thereof whereby the guide rollers are cantilevered over the web, the guide rollers of each pair having axes lying in a common plane perpendicular to a plane of the web at the guide device, each of the pairs of guide rollers being inclined opposite the rollers of the other pair to the direction.

The present invention thus provides a combination of spreading rollers extending the full width of the web with guide rollers provided in pairs immediately downstream of the spreading rollers and which, because of their cantilevered mounting, only engage the web in the edge regions thereof with the significant advantage that the spreading rollers hold the web precisely in the feed plane, because a lateral movement of the web out of the rollers extending continuously across the web is not possible.

The guide rollers, because they are cantilevered outwardly of the longitudinal edge can capture the goods even after the latter may have had an edge spring inwardly and, of course, the continuous spreading rollers prevent the spreading rollers from catching on possible holes or tears in the fabric web.

The combination of the invention thus ensures a uniform stress distribution over the web so that even light and highly sensitive webs can be guided with ease.

It will be understood that the guide roller pairs with their fingerlike rollers and cantilevered mounts, occupy only very little space. The control for web correction does not require a lateral swinging out of the roller pairs, because these rollers generate their correction effect perpendicular to the web-guide plane.

The combined unit is structurally simple and compact and inspite of these advantages also allows a correction effect for the web to be generated with a high degree of precision.

Since even the drive of rollers of the roller pairs for the correction effect on the web is simple, the apparatus can be realized at relatively low cost.

Since the roller pairs do not have any direct connection with one another, because the fingerlike rollers only act on the edge regions of the fabric, adjustment of the system to different web widths is accomplished with ease and in a simple manner. The space required by the roller pairs laterally of the web is independent of the web width.

Advantageously, the guide device is mounted on the support means so that the guide device forms a structural unit with the spreading device. This means that expensive mounts for the guide device can be eliminated, since the latter is mounted on the support means for the spreading unit. In addition, this enables the distance between the spreading unit and the guide unit to be as small as possible so that the spreading effect still acts upon the web as the rollers of the roller pairs engage the web. This makes the correction especially accurate and precise. Of course, the arrangement also ensures that the entire apparatus will be short, simple and located easily in a processing path for the web.

Advantageously, respective edge sensors are located downstream of the pairs of guide rollers in the direction of advance of the web and are integrated into the unit. This makes it possible for the edge sensors to be built into the unit constituted of the guide and spreading devices, or to so combine the sensors with the roller pairs that they operate directly downstream of the latter.

The pairs of rollers should converge symmetrically in the latter direction which ensures that the web will be effectively gripped between the rollers of each roller pair with each roller pair drawing the web toward itself.

Of course, it is possible to provide one pair of rollers so that it clamps the web and draws its edge of the web toward the clamping roller pair when the other pair of rollers is released so that the correction will not be interfered with.

Advantageously, the convergence of the pairs of rollers in the direction of travel is adjustable. This allows the degree of correction contributed by each pair of rollers to be varied. Furthermore, since the guide rollers are free-running so that at least in the fabric travel direction, only minor mechanical stress is applied by the pairs of guide rollers to the web.

An especially advantageous embodiment of the invention has one of the rollers of each pair movable relative to the other roller to adjust the nip between the guide rollers of the two pairs. This allows the force with which the rollers grip the web to be adjusted and, of course, the degree to which the web is pulled to one side or the other, since that action will depend on the degree to which the rollers are tightened against the web. The control of the movement of at least the movable roller of each pair can be realized in a simple manner, since the force required is small. Because the nip between the rollers of each pair forms a linear gap coplanar with the contact line at which the web leads the downstream spreading roller, there is no need to have the web loop around either of the guide rollers of each pair to any significant extent. This prevents distortion of the web. In addition, the tongs-like action can be provided for clamping the web and controlling the correction contributed thereto. The rollers of each pair can be moved parallel to one another or can be provided for one or both of the rollers of each pair, i.e. they can have a pivotal movement about pivots at the cantilevered end of the rollers.

An especially important feature of the invention is the means for precise alignment as described, utilizing nips which are precisely coplanar with the contact line of the downstream roller. The two pairs of rollers can uniformly grip the web from both sides and one of the rollers will not be looped to a greater extent than another to cause potential tearing of the web.

Advantageously, the pairs of guide rollers are journaled in respective housings mounted on holders movable on the support means of the spreading device. The alternative, of course, is to have the holders separate from the latter, although this requires sufficient space. The particular approach used will depend upon the specific requirements of the apparatus.

Guide means can extend transversely of the direction of travel of the web for guiding these holders transversely of this direction, adjusting means being provided for displacing the holders oppositely to one another. This allows the roller pairs to be exactly positioned with respect to one another as well as adjustment with the varying widths of guide webs to be handled.

The guide means can, moreover, include a threaded spindle extending all across the width and carrying the holders or a track for the holders. The adjusting means can include manual, mechanical or electromechanical means for rotating the threaded spindle. In a highly compact unit, this ensures accurate positioning of the roller pairs.

BRIEF DESCRIPTION OF THE DRAWING

The above objects, features and advantages of our invention will become more readily apparent from the following description, reference being made to the accompanying drawing in which.

SPECIFIC DESCRIPTION

Figure 1:
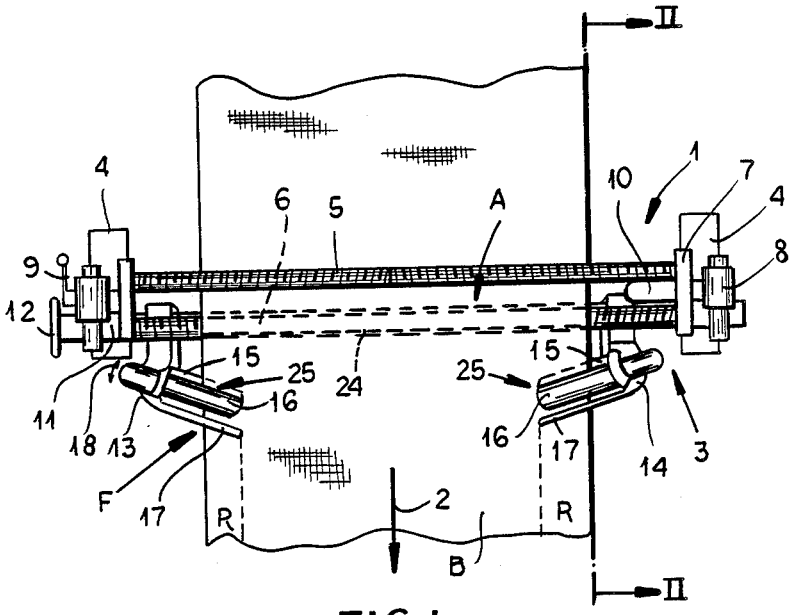
FIG. 1 is a diagrammatic elevational view of an apparatus for spreading and guiding a travelling fabric web.

The apparatus 1 shown in FIG. 1 for spreading and guiding a fabric web B which, as is the most common case, is travelling vertically in the direction of the arrow 2 representing the travel direction, comprising a spreading device A followed in the travel direction 2 by a guide device F located at an ultimately same distance from the spreading device. In the illustrated embodiment, the spreading device A forms a common structural unit 3 with the guide device F on a stationary support 4.

The spreading device A comprises an upstream spreading roller 5 downstream of which is a second spreading roller 6 parallel to the spreading roller 5.

The two spreading rollers 5 and 6 have lengths greater than the width of the web and are journaled at their ends in support members 7 forming part of the support means for the spreading apparatus. A drive 8 is connected to the spreading rollers 5 and 6 so that they can have their peripheries rotated at peripheral speeds greater than that of the web B and frequently in a reverse sense, i.e. backwards.

As is described in the aforementioned German Patent Document, the surface of each spreading roller 5, 6 has extending toward an end from the center of the roller, a threadlike structure in which the helices of the two sections of each roller 5 and 6 extending toward the respective side of the web wind in an opposite sense or hand from the other section of the thread. Because the threads of the rollers are in contact with the opposite surfaces of the web, longitudinal folds or edge rolling of the web are spread out and the web is stressed in a transverse direction.

The spreading device A is so mounted upon the support 4 that the downstream spreading roller 6 has a stationary axis while the axis of the upstream spreading roller 5 is swingable with the support member 7 about the axis of the spreading roller 6 (FIG. 2, arrow 20), to loop the web B to a greater or lesser extent around these spreading rollers. The degree of this pivotal movement is controlled by a lever 9 which can be connected to a servomechanism or remote-controlled actuator. For this movement, the drive system coupled to the spreading rollers 5, 6 has been represented at 10.

In the embodiment illustrated, the unit 3 which contains the spreading device is provided at each longitudinal side of the web B with a transverse holder 11 on which housings 13 and 14 are mounted so as to be transversely shiftable.

Figure 4:
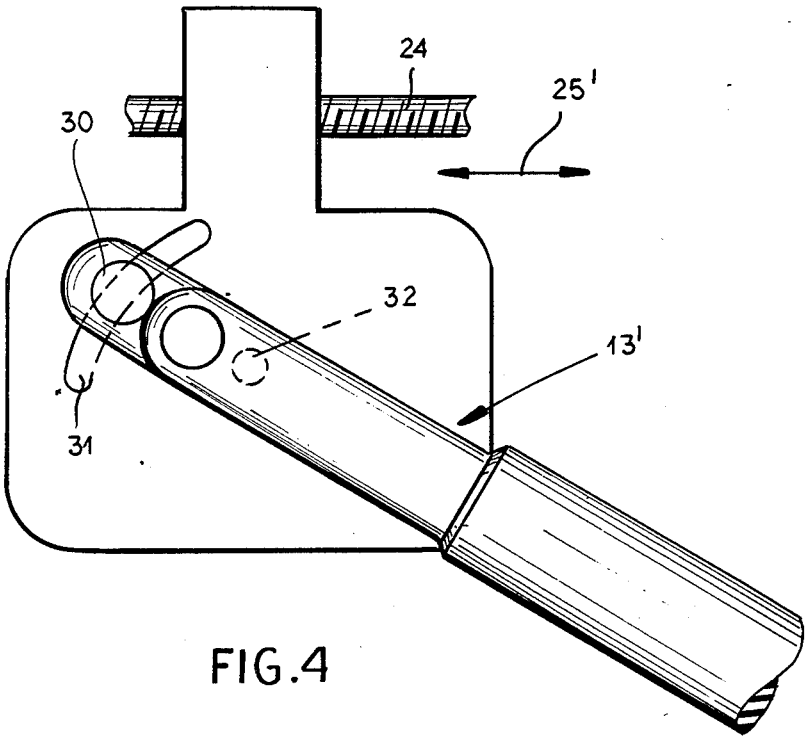
FIG. 4 is a plan view illustrating adjustability of the pair of guide rollers.

A threaded spindle 24 extends through the holders 11 and is generally parallel to the gripping roller 6. The spindle 24 is provided with the hand while 12 for manual rotation of this spindle and this hand can also be symbolic of other mechanical or electromechanical means for driving the spindle. The spindle has oppositely threaded ends engaging the housings 13 and 14 so as to shift them in the direction of the arrow 25 (see FIG. 4 where a similar housing arrangement has been shown at 13').

This allows adjustment of the pairs of guide rollers to webs of different widths.

The mechanical or electromechanical adjustment of the spindle can also be remotely controlled, if desired.

Each housing 13 and 14 is provided with a roller pair 25 having two fingerlike freely rotatable and guide rollers 15 and 16 cantilevered on the housing and journaled thereto at one end. The roller pairs 25 are inclined with respect to the direction of travel 2 of the web and converge toward one another in this direction.

Figure 2:
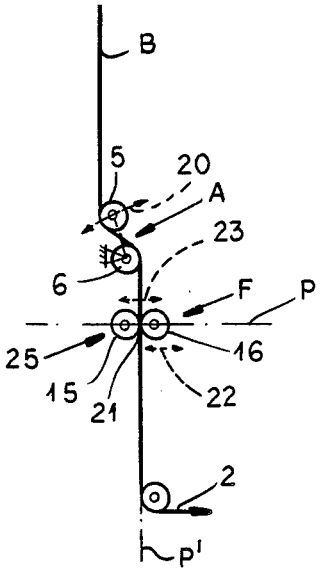
FIG. 2 is a section in highly schematic form taken along the line II—II of FIG. 1.
Figure 3:
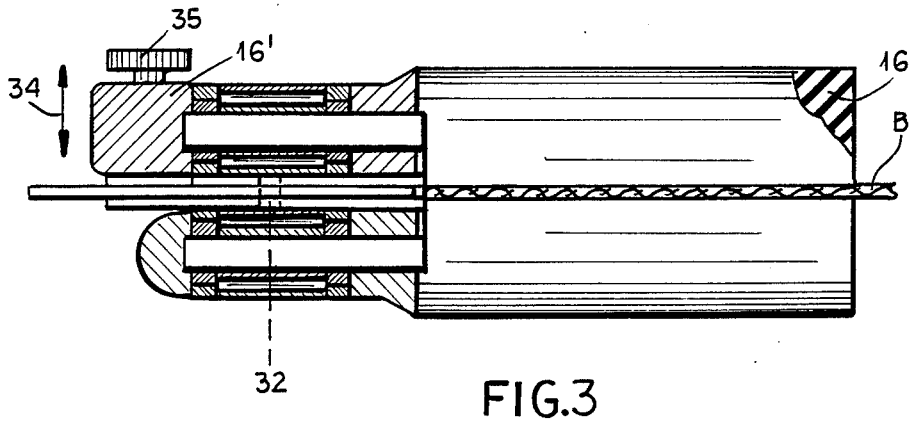
FIG. 3 is a detail view partly broken away showing how a pair of rollers can be mounted in the guide device.

The convergence of the roller pairs 25 can be adjustable as represented by the arrow 18 in FIG. 2 to vary the convergence of the respective roller pair. In the embodiment of FIG. 3, a screw 30 which is guided in a slot 31 can be loosened to permit the pair of rollers to be swung as indicated by this arrow, about a pivot 32 on the respective housing structure 13'.

The two rollers 15 and 16 of each roller pair 25 have their axes lying in a common plane P which is perpendicular to the plane of the web B so that a linear nip 21 is formed which is coplanar with the line 33 at which the web leaves the downstream roller 6. The plane of the web is here represented at P' (FIG. 2).

The plane P' is tangent to one of the rollers 15 and to the roller 6. This ensures that the web B will not be looped around one of the two rollers 15 or 16 of each roller pair to a greater extent than around the other and thus reduces tearing which might otherwise result from such looping.

The two rollers 15 and 16, which can have smooth and soft elastic surfaces, can be swung together and apart in a tongs-like manner. Alternatively, the roller 16, for example, may be moved toward the roller 15 in a parallel movement represented by the arrow 22 in FIG. 2 and the arrow 34 in FIG. 3. The means for this parallel movement is here shown to be a screw 35 engaging a housing portion 16' in which the roller 16 is journaled.

Alternatively, the roller 16 may be pivotally mounted at its cantilevered end to swing toward the roller 15, like the swing of a toll barrier. Instead of a manual drive at 35, an electromechanical or servodrive can be provided for this purpose.

Each of the housings 13, 14 can carry an edge sensor 17 which can sense the position of the edge of the web B immediately downstream from the roller pairs 25 and can control via an appropriate control system, the position or state of the guide rollers 15 and 16. Spaced below the guide device F is a fixed axis roller 19 beneath which the web B passes in changing direction to the horizontal.

In operation of the apparatus 1, the web B is spread between the spreading rollers 5 and 6 by the rapid rotation thereof on contact with the web so that longitudinal folds and rolled edges are drawn laterally outwardly. Directly thereafter the web B passes from the downstream spreading roller 6 into the nip 21 of each roller pair 25.

As long as the web portion coincides with the desired position of the path, as determined by the sensors 17, the two rollers 15 and 16 of each roller pair 25 will bear with only negligible pressure on the two sides of the edge regions R of the web B. If there is a tendency of the web B to move to the left (in FIG. 1) when the edge sensors 17 detect this movement beyond a predetermined tolerance level. The two rollers 15, 16 of the housing 13 are pressed together more firmly automatically or manually while the rollers 15, 16 of housing 14 remain unchanged or are opened so that position of the web B is covered by guidance toward the right into the setpoint position. The two roller pairs 25 can operate selectively or together with varying pressures and angles of inclination as controlled automatically by the sensors 17 or manually.

We claim:

1. An apparatus for spreading and guiding a flexible web, comprising:

a spreading device disposed along a path of a moving flexible web and including:

two spaced-apart spreading rollers extending across a width of said web generally transverse to a travel direction thereof, each of said spreading rollers being formed with thread formations of opposite hand at each longitudinal side of said web, said spreading rollers engaging opposite surfaces of said web, common support means for journaling said spreading rollers, and means for rotating said spreading rollers to spread said web as said web is engaged by said spreading rollers; and a guide device downstream of said spreading rollers in said direction, said guide device including:

respective pairs of fingerlike guide rollers straddling and engaging between the rollers of each pair only respective longitudinal-edge regions of said web at said opposite sides thereof, and means for journaling said guide rollers only at ends thereof whereby said guide rollers are cantilevered over said web, the guide rollers of each pair having axes lying in a common plane perpendicular to a plane of the web at said guide device, each of said pairs of guide rollers being inclined opposite the rollers of the other pair to said direction, said guide device being mounted on said support means so that said guide device forms a structural unit with said spreading device.

2. The apparatus defined in claim 1, further comprising respective edge sensors located downstream of said pairs of guide rollers in said direction and integrated in said unit.

3. The apparatus defined in claim 1 wherein the pairs of rollers converge symmetrically in said direction.

4. The apparatus defined in claim 1 wherein a convergence of said pairs of rollers in said direction is adjustable.

5. The apparatus defined in claim 1 wherein one of the rollers of each pair is movable relative to the other roller of the respective pair to adjust a nip between said guide rollers of said pairs.

6. The apparatus defined in claim 1 wherein a downstream one of said spreading rollers in said direction has a fixedly positioned axis and nips between said pairs of guide rollers are precisely aligned with a line at which said web leaves said one of said spreading rollers in a plane between said one of said spreading rollers and said guide rollers.

7. The apparatus defined in claim 1 wherein said pairs of guide rollers are journaled in respective housings mounted on holders moveable on said support means transversely to said direction.

8. The apparatus defined in claim 7, further comprising guide means extending transversely of said direction and guiding said holders transversely of said direction, and adjusting means for displacing said holders oppositely.

9. The apparatus defined in claim 8 wherein said guide means includes a threaded spindle extending all across said width and carrying said holders, said adjusting means being means for rotating said spindle.

10. The apparatus defined in claim 8 wherein said means for rotating said spindle includes a manual actuator.

11. The apparatus defined in claim 8 wherein said means for rotating said spindle includes a mechanical actuator.

12. The apparatus defined in claim 8 wherein said means for rotating said spindle includes an electromechanical actuator.

13. The apparatus defined in claim 1, further comprising respective edge sensors located downstream of said pairs of guide rollers in said direction and integrated in said unit.

14. The apparatus defined in claim 13 wherein the pairs of rollers converge symmetrically in said direction.

15. The apparatus defined in claim 14 wherein a convergence of said pairs of rollers in said direction is adjustable.

16. The apparatus defined in claim 15 wherein one of the rollers of each pair is movable relative to the other roller of the respective pair to adjust a nip between said guide rollers of said pairs.

17. The apparatus defined in claim 16 wherein a downstream one of said spreading rollers in said direction has a fixedly positioned axis and nips between said pairs of guide rollers are precisely aligned with a line at which said web leaves said one of said spreading rollers in a plane between said one of said spreading rollers and said guide rollers.

18. An apparatus for spreading and guiding a flexible web, comprising:

a spreading device disposed along a path of a moving flexible web and including:

two spaced-apart spreading rollers extending across a width of said web generally transverse to a travel direction thereof, each of said spreading rollers being formed with thread formations of opposite hand at each longitudinal axis of said web, said spreading rollers engaging opposite surfaces of said web, common support means for journaling said spreading rollers, and means for rotating said spreading rollers to spread said web as said web is engaged by said spreading rollers; and a guide device downstream of said spreading rollers in said direction, said guide device including:

respective pairs of fingerlike guide rollers straddling and engaging between the rollers of each pair only respective longitudinal-edge regions of said web at said opposite sides thereof, and means for journaling said guide rollers only at ends thereof whereby said guide rollers are cantilevered over said web, the guide rollers of each pair having axes lying in a common plane perpendicular to a plane of the web at said guide device, each of said pairs of guide rollers being inclined opposite the rollers of the other pair to said direction, said pairs of guide rollers being journaled in respective housings mounted on holders moveable on said support means transversely to said direction, guide means extending transversely of said direction being provided for guiding said holders transversely of said direction and having adjusting means for displacing said holders oppositely, said guide device being mounted on said support means so that said guide device forms a structural unit with said spreading device.

* * * * *